US008032061B2

(12) United States Patent
Park et al.

(10) Patent No.: US 8,032,061 B2
(45) Date of Patent: Oct. 4, 2011

(54) ELECTROPHOTOGRAPHIC IMAGE FORMING APPARATUS HAVING TRANSPARENT TONER AND WHITE TONER

(75) Inventors: Jong-woo Park, Seoul (KR); Won Choe, Yongin-si (KR); Ki-jae Do, Suwon-si (KR)

(73) Assignee: Samsung Electronics Co., Ltd, Suwon-Si (KR)

( * ) Notice: Subject to any disclaimer, the term of this patent is extended or adjusted under 35 U.S.C. 154(b) by 1022 days.

(21) Appl. No.: 11/773,010

(22) Filed: Jul. 3, 2007

(65) Prior Publication Data

US 2008/0153017 A1 Jun. 26, 2008

(30) Foreign Application Priority Data

Dec. 26, 2006 (KR) ..... 10-2006-0134159

(51) Int. Cl.
*G03G 15/01* (2006.01)

(52) U.S. Cl. ..... 399/225; 399/296; 399/299

(58) Field of Classification Search ..... 399/225, 399/299, 296
See application file for complete search history.

(56) References Cited

U.S. PATENT DOCUMENTS

| | | | | |
|---|---|---|---|---|
| 2,297,691 | A * | 10/1942 | Carlson | 430/55 |
| 5,155,541 | A * | 10/1992 | Loce et al. | 399/232 |
| 5,893,664 | A * | 4/1999 | Kumasaka et al. | 399/296 |
| 2006/0127134 | A1 | 6/2006 | Sakamaki et al. | |

FOREIGN PATENT DOCUMENTS

| | | | |
|---|---|---|---|
| JP | 2002-108039 | | 4/2002 |
| JP | 2005-037582 | * | 2/2005 |
| JP | 2006-078883 | | 3/2006 |

OTHER PUBLICATIONS

Japanese Patent Office machine-assisted translaton of JP 2005-037582 (pub. Feb. 2005).*

Chinese Office Action issued Aug. 24, 2010 in CN Application No. 200710142686.8.

Korean Non-Final Rejection issued Mar. 25, 2011 in KR Application No. 10-2006-0134159.

* cited by examiner

*Primary Examiner* — Janis L Dote
(74) *Attorney, Agent, or Firm* — Stanzione & Kim, LLP

(57) ABSTRACT

An electrophotographic image forming apparatus including first and second photosensitive bodies, first and second exposing units to form electrostatic latent images on the first and second photosensitive bodies respectively charged to a uniform electric potential, a first developing unit to develop an electrostatic latent image of the first photosensitive body by supplying a color toner to the electrostatic latent image of the first photosensitive body, and a second developing unit in which a transparent toner and a white toner charged to different polarities are contained and which develops a transparent toner image and a white toner image by respectively supplying the transparent toner and the white toner to an image portion and a non-image portion of an electrostatic latent image of the second photosensitive body.

5 Claims, 5 Drawing Sheets

ELECTROPHOTOGRAPHIC IMAGE FORMING APPARATUS HAVING TRANSPARENT TONER AND WHITE TONER

CROSS-REFERENCE TO RELATED APPLICATIONS

This application claims the benefit of Korean Patent Application No. 10-2006-0134159, filed on Dec. 26, 2006, in the Korean Intellectual Property Office, the disclosure of which incorporated herein in its entirety by reference.

BACKGROUND OF THE INVENTION

1. Field of the Invention

The present general inventive concept relates to an image forming apparatus, and more particularly, to an electrophotographic image forming apparatus having a transparent toner and a white toner.

2. Description of the Related Art

Electrophotographic image forming apparatuses form an electrostatic latent image by scanning light onto a photosensitive body charged to a uniform electric potential, developing the electrostatic latent image with a predetermined color of toner, and then transferring and fusing the developed image to and on a printing medium, thereby printing a desired image. In general, four colors of toners, such as yellow (Y), magenta (M), cyan (C), and black (B), are used in electrophotographic color image forming apparatuses, and four developing units are used to develop the electrostatic latent image formed on the photosensitive body with these four colors of toners.

A toner is manufactured based on a plastic resin, which has some gloss. Since printed images may have portions that use toner and other portions that do not use toner, the printed image may have inconsistencies with respect to glossiness and appearance. In other words, the toner adds gloss to the printed image where the toner is attached, but a background region of the printed image to which the toner is not attached has no gloss. In addition, when a toner-coverage area of the printed image is higher, the concentration of gloss is correspondingly higher, which affects the visual quality of the image. U.S. Patent Application No. 20060127134 discloses an image forming apparatus featuring a transparent image forming station to improve the gloss of a printed image by employing developing devices to develop electrostatic images with color toners and a developing device to develop an electrostatic image with a transparent toner.

SUMMARY OF THE INVENTION

The present general inventive concept provides an electrophotographic image forming apparatus having an improved structure in which electrostatic latent images are developed with a transparent toner and a white toner, respectively, using one developing unit.

Additional aspects and/or utilities of the present general inventive concept will be set forth in part in the description which follows and, in part, will be obvious from the description, or may be learned by practice of the general inventive concept.

The foregoing and/or other aspects and utilities of the present general inventive concept may be achieved by providing an electrophotographic image forming apparatus including first and second photosensitive bodies, first and second exposing units to form electrostatic latent images on the first and second photosensitive bodies respectively charged to a uniform electric potential, a first developing unit to develop the electrostatic latent image of the first photosensitive body, and a second developing unit having a transparent toner and a white toner charged to different polarities to develop the electrostatic latent image having a transparent toner image and a white toner image by supplying the transparent toner to an image portion of the electrostatic latent image and the white toner to a non-image portion of an electrostatic latent image of the second photosensitive body.

The apparatus may include a pre-transfer charging unit to charge a transparent toner image and a white transparent toner image respectively developed on the second photosensitive body to the same polarity.

The apparatus may include color images printed using a single pass technique using the plurality of first photosensitive bodies, the plurality of first exposing units which form electrostatic latent image on the plurality of first photosensitive bodies, and the plurality of first developing units which develops the electrostatic latent images of the plurality of first photosensitive bodies by supplying different color toners thereto.

The plurality of color toner images and the transparent toner image and the white toner image may be directly transferred to a printing medium carried by a carrying belt, and the second photosensitive body may be positioned in a carrying direction of the printing medium on a lower-most stream side with respect to an upper-most stream side.

The apparatus may include a transfer medium on which a plurality of color toner images formed on the plurality of first photosensitive bodies, and a transparent toner image and a white toner image formed on the second photosensitive body are transferred, wherein the second photosensitive body may be positioned in a progressive direction of the transfer medium on an upper-most stream side with respect to a lower-most stream side.

The foregoing and/or other aspects and utilities of the present general inventive concept may also be achieved by providing an electrophotographic image forming apparatus including a photosensitive body, an exposing unit to form an electrostatic latent image on the photosensitive body charged to a uniform electric potential, a plurality of first developing units having a color toner used to develop the electrostatic latent image of the photosensitive body is accommodated, a second developing unit having a transparent toner and a white toner charged to different polarities to develop the electrostatic latent image having a transparent toner image and a white toner image by supplying the transparent toner to an image portion of the electrostatic latent and the white toner to a non-image portion of the electrostatic latent image of the photosensitive body, and a transfer medium to which the color toner image, the transparent toner image, and the white toner image respectively developed on the photosensitive body are sequentially transferred.

The apparatus may further include a pre-transfer charging unit to charge a transparent toner image and a white transparent toner image respectively developed on the photosensitive body to the same polarity before they are transferred to the transfer medium.

Color images may be printed using a multiple pass technique by a plurality of the first developing units having different color toners.

The second developing unit may first perform a developing operation.

The foregoing and/or other aspects and utilities of the present general inventive concept may also be achieved by providing an electrophotographic image forming apparatus including at least one photosensitive body, and a plurality of developing units to develop an electrostatic latent image formed on the photosensitive body and supply a toner to the electrostatic latent image, wherein a transparent toner and a white toner are charged to different polarities and are both contained in one of the plurality of developing units.

The foregoing and/or other aspects and utilities of the present general inventive concept may also be achieved by providing a method of an electrophotographic image forming apparatus, the method including forming an electrostatic latent image on first and second photosensitive bodies, supplying a color toner to the electrostatic latent image of the first photosensitive body to develop the electrostatic latent image, the electrostatic latent image having an image portion and a non-image portion, supplying a transparent toner to the image portion of the electrostatic latent image of the second photosensitive body, and supplying a white toner to the non-image portion of the electrostatic latent image of the second photosensitive body.

The method may further include charging the transparent toner and the white toner to different polarities.

The method may further include containing the transparent toner and the white toner in a single developing unit.

The method may further include transferring a color toner image and a transparent toner image sequentially via a transfer medium.

The transparent toner and the white toner may have equal glossiness.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
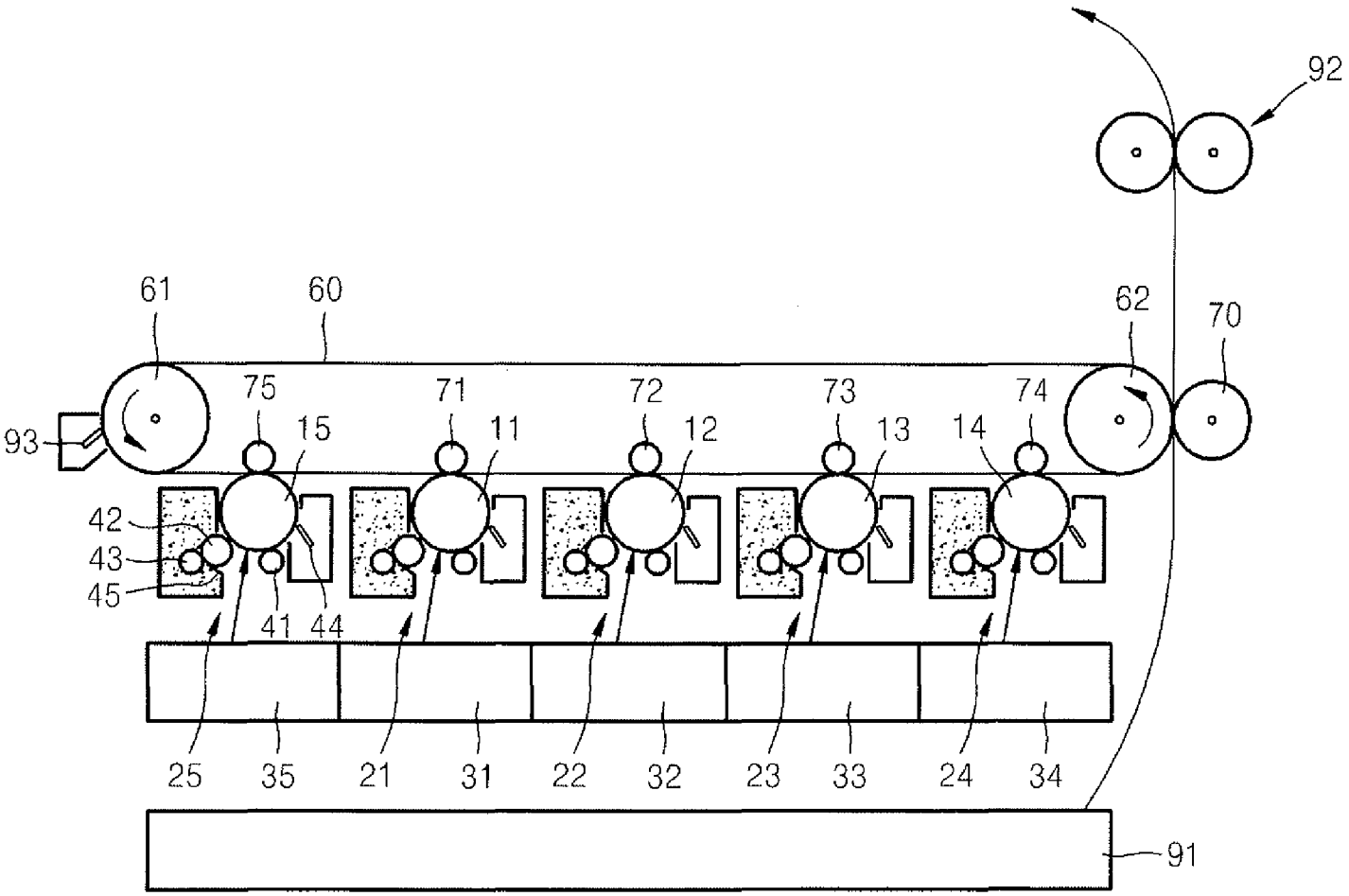
FIG. 1 illustrates the structure of a single pass color image forming apparatus which is a type of an electrophotographic image forming apparatus, according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 illustrates the structure of an electrophotographic image forming apparatus according to an embodiment of the present general inventive concept. Referring to FIG. 1, the electrophotographic image forming apparatus according to the present embodiment is a single pass color image forming apparatus which includes four first photosensitive drums 11, 12, 13, and 14, four first exposing units 31, 32, 33, and 34, and four first developing units 21, 22, 23, and 24 to provide color printing. However, only one of the four first photosensitive drums 11, 12, 13, and 14, only one of the four first exposing units 31, 32, 33, and 34, and only one of the four first developing units 21, 22, 23, and 24 are needed to mono-color print. In addition, the image forming apparatus according to the present embodiment includes a second photosensitive drum 15, a second exposing unit 35, and a second developing unit 25, which are used to develop electrostatic latent images with a transparent toner and a white toner, respectively.

Color toners such as black (B), magenta (M), cyan (C), and yellow (Y) are accommodated in the first developing units 21, 22, 23, and 24.

Each of the first photosensitive drums 11, 12, 13, and 14 and the second photosensitive drum 15 is an example of a photosensitive body on which an electrostatic latent image is to be formed, which may include, for example, an organic photosensitive body and/or an Amorphous silicon photosensitive body having a long life span. Each of the first photosensitive drums 11, 12, 13, and 14 corresponds to each of the first developing units 21, 22, 23, and 24, and the second photosensitive drum 15 corresponds to the second developing unit 25.

Each of charging rollers 41 is an example of a charging unit to charge each of the first and second photosensitive drums 11, 12, 13, 14, and 15 to a uniform surface electric potential. The charging rollers 41 are in contact with the first and second photosensitive drums 11, 12, 13, 14, and 15, respectively. A charging bias voltage is applied to each of the charging rollers 41, and each charging roller 41 charges the surface of each of the first and second photosensitive drums 11, 12, 13, 14, and 14 to a uniform electric potential.

Each of the first exposing units 31, 32, 33, and 34 scans light modulated according to image information controlling application of black (B), magenta (M), cyan (C), and yellow (Y) colors, respectively, onto the first photosensitive drums 11, 12, 13, and 14 and thereby forms electrostatic latent images. A second exposing unit 35 scans light modulated according to image information about a transparent color and a white color image onto the second photosensitive drum 15 and thereby forms an electrostatic latent image. A laser scanning unit (LSU) that uses a laser diode as a light source is usually used as each of the first and second exposing units 31, 32, 33, 34, and 35.

Each of the first and second developing units 21, 22, 23, 24, and 25 includes a developing roller 42 and a supply roller 43. The supply roller 43 attaches the toner accommodated in each of the first and second developing units 21, 22, 23, 24, and 25 to the developing roller 42. The first and second developing units 21, 22, 23, 24, and 25 may further include a regulating unit 45 which regulates the amount of the toner attached to the surface of the developing roller 42 to form a layer of toner having a uniform thickness. For example, the regulating unit 45 may be an elastic plate or roller which is in elastic contact with the developing roller 42. The first and second developing units 21, 22, 23, 24, and 25 may further include at least one carrying means (not illustrated) to carry the toner accommodated in each of the developing units 21, 22, 23, 24, and 25 into a region in which the developing roller 42 and the supply roller 43 face each other. When a contact developing technique is used, the developing rollers 42 are in contact with the first and second photosensitive drums 11, 12, 13, 14, and 15. A developing bias voltage, which is used to supply the toner accommodated in each of the first and second developing units 21, 22, 23, 24, and 25 to electrostatic latent images of the first and second photosensitive drums 11, 12, 13, 14, and 15, is applied to each of the developing rollers 42. Due to the developing bias voltage, an electric potential difference between the developing rollers 42 and the electrostatic latent images is produced so that the toners detach from the surface of the developing rollers 42 and attach to the electrostatic latent images, thus developing the electrostatic latent images with the toners. When a non-contact developing technique is used, each of the developing rollers 42 is positioned to maintain a developing gap between each of the first and second photosensitive drums 11,12, 13,14, and 15. For example, a bias voltage in which an AC current and a DC current are mixed, may be used as a developing bias voltage. The case where the contact developing technique is used will now be described.

An intermediate transfer belt 60 is an example of an intermediate transfer medium to which toner images developed on the first and second photosensitive drums 11, 12, 13, 14, and 15 are temporarily transferred. The intermediate transfer belt 60 faces the first and second photosensitive drums 11, 12, 13, 14, and 15, is supported by support rollers 61 and 62 and travels circulatively. Each of first transfer rollers 71, 72, 73, 74, and 75 faces a respective one of the first and second photosensitive drums 11, 12, 13, 14, and 15, and the intermediate transfer belt 60 is placed therebetween. A first transfer bias voltage used to attach the toner images developed on the first and second photosensitive drums 11, 12, 13, 14, and 15 to the intermediate transfer belt 60, is applied to each of the first transfer rollers 71, 72, 73, 74, and 75. For example, a conductive metal roller and/or a rubber roller in which a semiconductive rubber having elasticity is put on a metal shaft (not illustrated) may be used as each of the first transfer rollers 71, 72, 73, 74, and 75.

A cleaning blade 44 is used to eliminate the toner that remains on the surface of the first and second photosensitive drums 11, 12, 13, 14, and 15 after an intermediate transfer operation.

A second transfer roller 70 is positioned to face the intermediate transfer belt.

60. A printing medium stacked on a paper feeding cassette 91 is carried by a carrying means (not illustrated) between the second transfer roller 70 and the intermediate transfer belt 60. A second transfer bias voltage used to transfer the toner images attached to the intermediate transfer belt 60 to the printing medium is applied to the second transfer roller 70. A fusing unit 92 fuses the toner images on the printing medium by applying heat and pressure to the printing medium.

The image forming apparatus according to the present general inventive concept is characterized in that a transparent (T) toner and a white (W) toner, as well as color toners of black (B), magenta (M), cyan (C), and yellow (Y), are further used. In particular, the image forming apparatus according to the present general inventive concept is characterized in that images are developed with the transparent (T) toner and the white (W) toner using one photosensitive body, one exposing unit, and one developing unit.

The transparent (T) toner and the white (W) toner are accommodated in the second developing unit 25. In addition, the transparent (T) toner and the white (W) toner have a characteristic that they are charged to opposite polarities. In the present embodiment, the case where a non-magnetic mono-component toner is used will be described wherein color toners and a transparent toner are charged to a negative (−) polarity and a white toner is charged to a positive (+) polarity. A colorant to cause a change in color of a binder resin, internal additives such as charge control agent (CCA), wax or the like, and external additives such as silica and titanium oxide ($TiO_2$) are added to the color toners. The composition of the transparent toner is almost the same as the composition of the color toners except for the colorant of the color toners. The content of wax in the transparent toner may be more than the content of wax in the color toners so as to improve the gloss of the transparent toner. For example, charging amounts of the color toners and the transparent toner are about −15 to −25 μC/g measured by a suction-type Faraday Gauge, and a layer of toner on a developing roller 42 is about 0.5 to 1 mg/cm$^2$. The composition of the white toner is almost the same as the composition of the color toners and the composition of the transparent toner except for the colorant, the CCA to adjust a charging polarity, and part of the external additives of the color toners.

An operation of forming an image using the above-described configuration will now be described.

Figure 2:
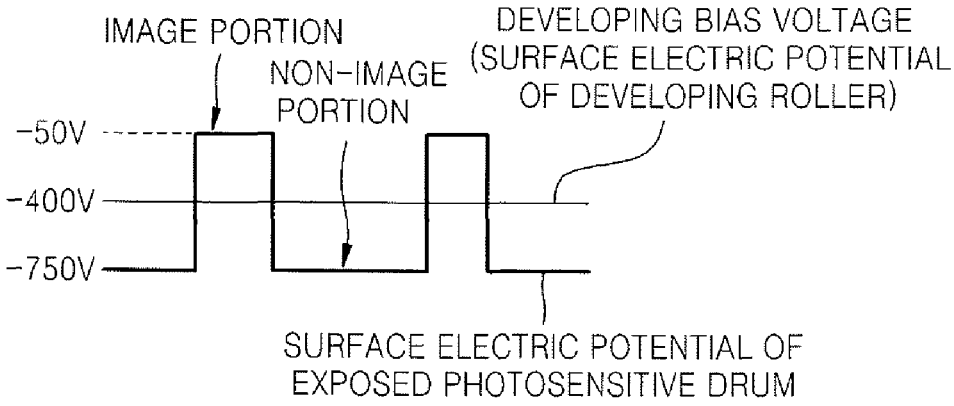
FIG. 2 illustrates an electric potential of the surface of an exposed photosensitive drum.
Figure 3:
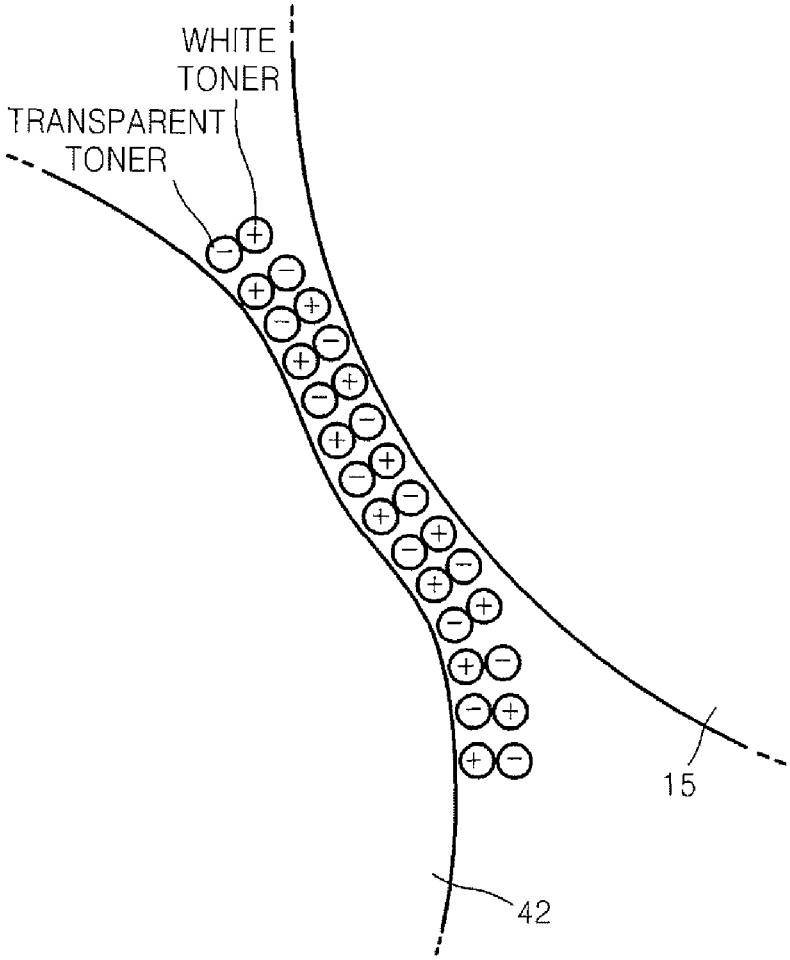
FIG. 3 is a detailed view of a portion in which a photosensitive drum and a developing roller are in contact with each other.

The second exposing unit 35 scans light onto the second photosensitive drum 15 charged by the charging roller 41 to a uniform electric potential according to image information about transparent (T) and white (W), and thereby forms an electrostatic latent image. For example, the surface electric potential of the second photosensitive drum 15 charged by the charging roller 41 is approximately −750V, as illustrated in FIG. 2. The electric potential of an image portion onto which light is scanned by the second exposing unit 35 is approximately −50V. A non-image portion onto which light is not scanned is maintained at the surface electric potential of the charged second photosensitive drum 15. A layer of a transparent toner and a white toner is formed on the surface of the developing roller 42 of the second developing unit 25, as illustrated in FIG. 3. At this time, in order to supply a sufficient amount of the transparent toner and the white toner to a developing region in which the developing roller 42 and the second photosensitive drum 15 face each other, the thickness of the toner layer formed on the surface of the developing roller 42 may be larger than the toner layer of the developing roller 42 of the first developing units 21, 22, 23, and 24. To this end, pressure applied to the developing roller 42 by the regulating unit 45 may be smaller than pressure applied by the regulating unit 45 of the first developing units 21, 22, 23, and 24. The average electric potential of the developing bias voltage applied to each developing roller 42 of the second developing unit 25 is between the electric potential of an image portion and the electric potential of the non-image portion. In the present embodiment, a developing bias voltage having the average electric potential of about −400V is applied to the developing roller 42. When the developing bias voltage is applied to the developing roller 42, the transparent toner and the white toner move to the second photosensitive drum 15. As described above, the transparent toner is charged to a negative (−) polarity and the white toner is charged to a positive (+) polarity. Thus, the transparent toner is detached from the surface of the developing roller 42 and is attached to the image portion while the white toner is attached to the non-image portion. Here, the image portion is a portion in which other color toner images are attached, and the non-image portion is a background portion in which other color toner images are not attached. The transparent toner image and the white toner image developed on the second photosensitive drum 15 are transferred onto the intermediate transfer belt 60 by the first transfer bias voltage applied to the first transfer roller 75.

Figure 4:
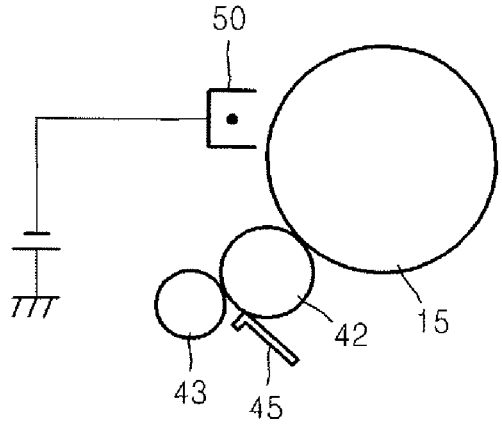
FIG. 4 illustrates a pre-transfer charging unit.

At this time, in order to improve the transfer efficiency of the transparent toner image and the white toner image, the charging polarities of the two toner images may be the same before the toner images are transferred onto the intermediate transfer belt 60. For example, the charging polarity of the white toner image may be the same as the charging polarities of the transparent toner image and other color toner images. To this end, a pre-transfer charging unit 50 is provided, as illustrated in FIG. 4. The pre-transfer charging unit 50 charges the white toner to the same negative (−) polarity as the charging polarities of the transparent toner and other color toners by supplying a negative (−) charge to the white toner. A first transfer bias voltage having a positive (+) polarity that is opposite to the polarities of the transparent and white toner images is applied to the first transfer roller 75. As such, the transfer efficiency of the transparent toner image and the white toner image can be improved.

Next, for example, according to the image information about the black (B) color, the first exposing unit 31 scans light onto the first photosensitive drum 11 charged by the charging roller 41 to a uniform electric potential and thereby forms an electrostatic latent image. The electric potential of the first photosensitive drum 11 is identical to that illustrated in FIG. 2. Since the black toner is charged to a negative (−) polarity when the developing bias voltage is applied to the developing roller 42, the black toner accommodated in the first developing unit 21 is attached to the image portion. A first transfer bias voltage having an opposite polarity to the charging polarity of the black toner is applied to the first transfer roller 71. As such, the black toner image developed on the first photosensitive drum 11 is transferred onto the intermediate transfer belt 60.

The same operation as described above is repeatedly performed by the first photosensitive drums 12, 13, and 14, the first exposing units 32, 33, and 34, and the first developing units 22, 23, and 24, respectively, at time intervals calculated by a formula: (distance between photosensitive drums)/(carrying speed of intermediate transfer belt). The formula ensures the operation meets color registration requirements.

Through the above-described operations, color toner images such as black (B), magenta (M), cyan (C), yellow (Y), and a transparent (T) toner image, and a white (W) toner image are formed on the intermediate transfer belt 60. When the color toner images reach a region in which the second transfer roller 70 and the intermediate transfer belt 60 face each other, the printing medium supplied from the paper feeding cassette 91 simultaneously reaches the region. A second transfer bias voltage having an opposite polarity to the charging polarities of the toner images is applied to the second transfer roller 70, at which point the toner images are transferred to the printing medium. The toners that remain on the intermediate transfer belt 60 after the transfer operation are eliminated by the cleaning member 93. When the printing medium passes the fusing unit 92, the toner images are fused on the printing medium by heat and pressure, which ends the printing operation.

According to the color images printed through the above-described operations, the image portion to which black (B), magenta (M), cyan (C), and yellow (Y) toners are attached is covered with the transparent toner. Thus, the gloss of the regions in which black (B), magenta (M), and cyan (C) toners are attached is improved while simultaneously providing uniform gloss in the regions. In addition, the background portion in which the color toner images and the transparent toner image are not attached is covered with the white toner image. While the color toner images are developed and transferred onto the intermediate transfer belt 60, part of the color toner images is attached to the background and causes contamination of the background portion. Such contamination is referred to as "fog." According to the present general inventive concept, fog is concealed by attaching the white toner image to the background portion so as to prevent contamination of the background portion, thus improving the quality of the printed image.

Figure 5:
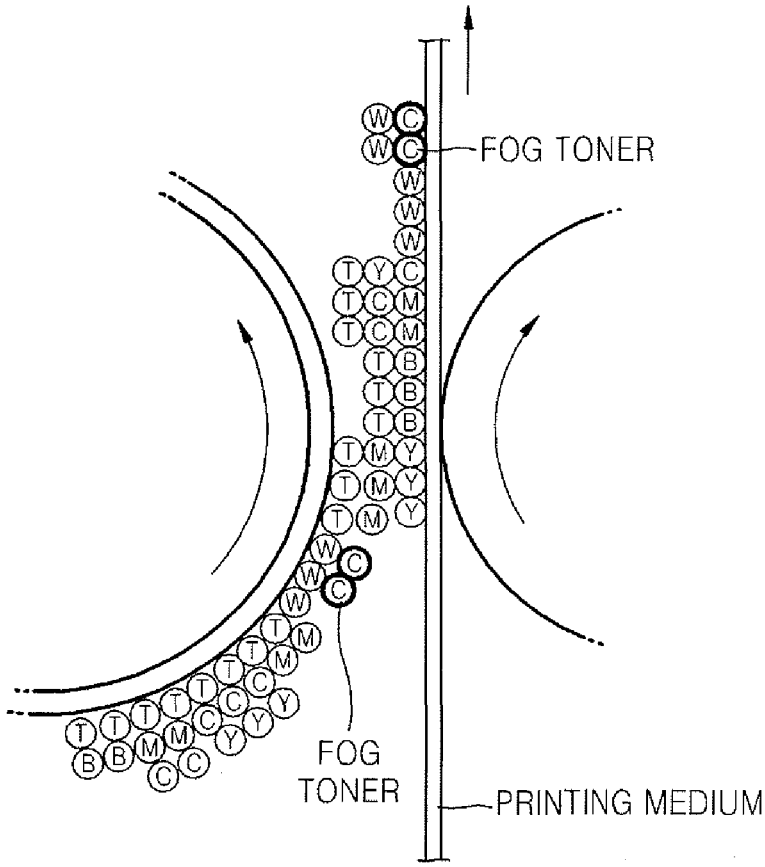
FIG. 5 illustrates an operation of transferring a toner image to a printing medium from an intermediate transfer belt.

In order to cover the color toner images with the transparent toner image and to conceal the fog of the color toner images with the white toner image, the second photosensitive drum 15 may be positioned on an upper-most stream side in a progressive direction of the intermediate transfer belt 60 and may be first transferred onto the intermediate transfer belt 60. As illustrated in FIG. 5, the transparent toner image on the intermediate transfer belt 60 is positioned under the color toner images. However, when the transparent toner image is transferred to the printing medium, the transparent toner image is positioned on the color toner images. In addition, when the white toner image is first transferred onto the intermediate transfer belt 60 and the contamination of the background portion occurs due to other color toner images, a fog toner image is positioned on the white toner image. After the toner image is transferred to the printing medium and the white toner image is positioned on top of the fog toner image, the fog toner image is covered with the white toner image.

As described above, according to the present general inventive concept, the transparent toner image and the white toner image are developed using one photosensitive body, one developing unit, and one exposing unit so that an economically efficient and miniaturized single pass color image forming apparatus to achieve two effects of improving the gloss of the printed image and preventing contamination of the background portion can be implemented.

In the above-described embodiments, the case where the transparent toner image and the white toner image are attached to the image portion and the non-image portion of the electrostatic latent image formed by the second exposing unit 35 on the second photosensitive drum 15, respectively, has been described. However, the scope of the present general inventive concept is not limited to this discription. When the transparent toner charged to the positive (+) polarity and the white toner charged to the negative (−) polarity are used, the white toner image and the transparent toner image are respectively attached to the image portion and the non-image portion of the electrostatic latent image formed on the second photosensitive drum 15. Thus, the transparent toner image is not limited to being developed in the image portion nor the white toner image limited to being developed in the non-image portion. Alternatively, the transparent toner and the white toner, each of which is charged to different polarities and accommodated in one developing unit, may be used to develop the toner images in different locations of the photosensitive body.

Figure 6:
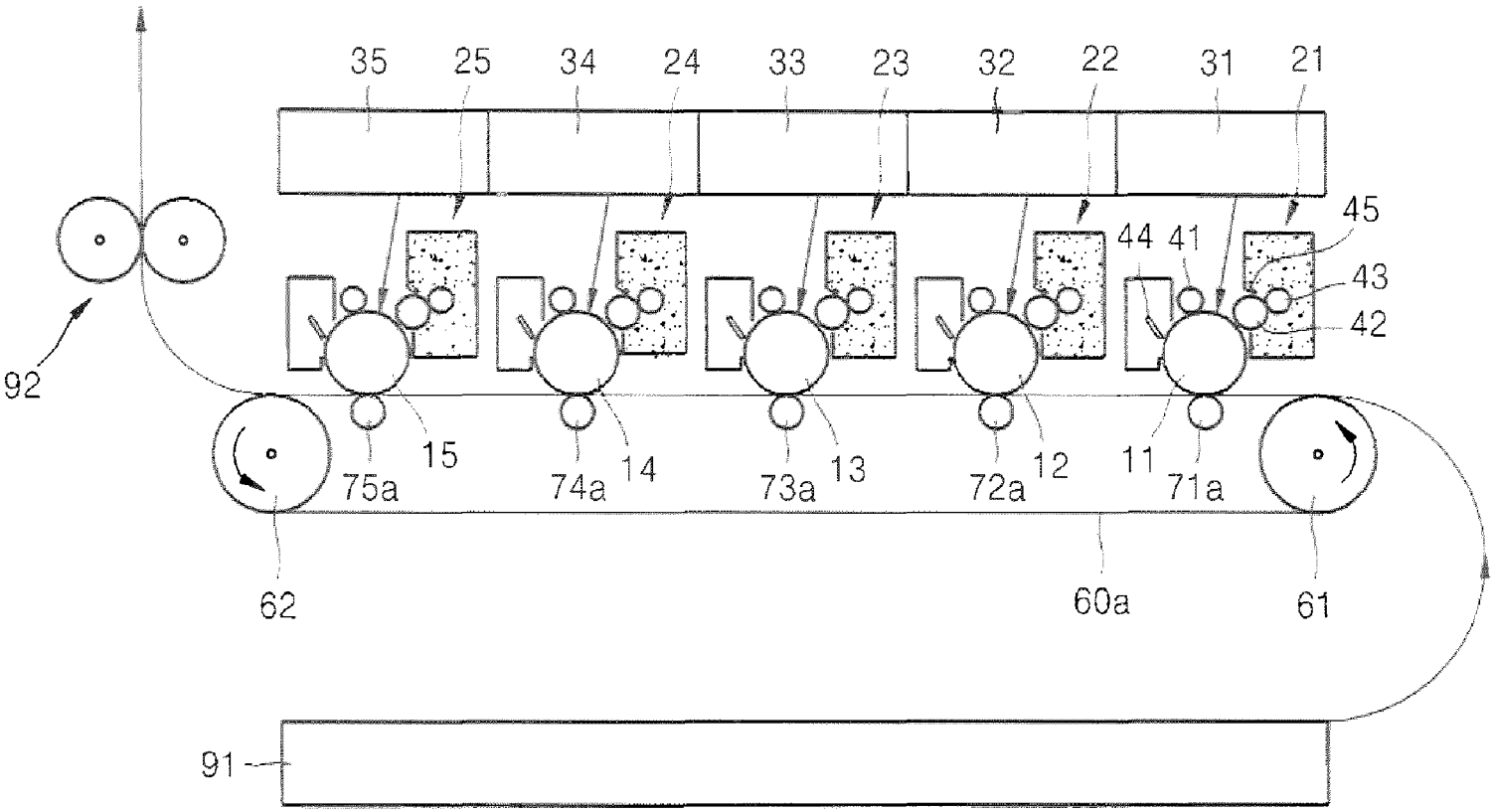
FIG. 6 illustrates the structure of a single pass color image forming apparatus employing a direct transfer technique which is a type of an electrophotographic image forming apparatus, according to another embodiment of the present general inventive concept.

The above-described technique to develop the transparent toner image may also be applied to a single pass image forming apparatus having a direct transfer technique in which a toner image is directly transferred to a printing medium while an intermediate transfer operation is not performed, as illustrated in FIG. 6. Referring to FIG. 6, the printing medium withdrawn from the paper feeding cassette 91 is carried by a carrying belt 60*a*. Each of the transfer rollers 71*a*, 72*a*, 73*a*, 74*a*, and 75*a* faces each of the first and second photosensitive drums 11, 12, 13, 14, and 15 in the state where the printing medium and the carrying belt 60a are placed therebetween. The color toner images, the transparent toner image, and the white toner image developed on the first and second photosensitive drums 11, 12, 13, 14, and 15 are directly transferred to the printing medium by a transfer bias voltage applied to each of the transfer rollers 71*a*, 72*a*, 73*a*, 74*a*, and 75*a*. In this case, in order to cover the color toner images with the transparent toner image and to conceal the fog of the color toners with the white toner image, the second photosensitive drum 15 may be positioned on a lower-most stream side in a progressive direction of the carrying belt 60*a* and may be last transferred to the printing medium.

Figure 7:
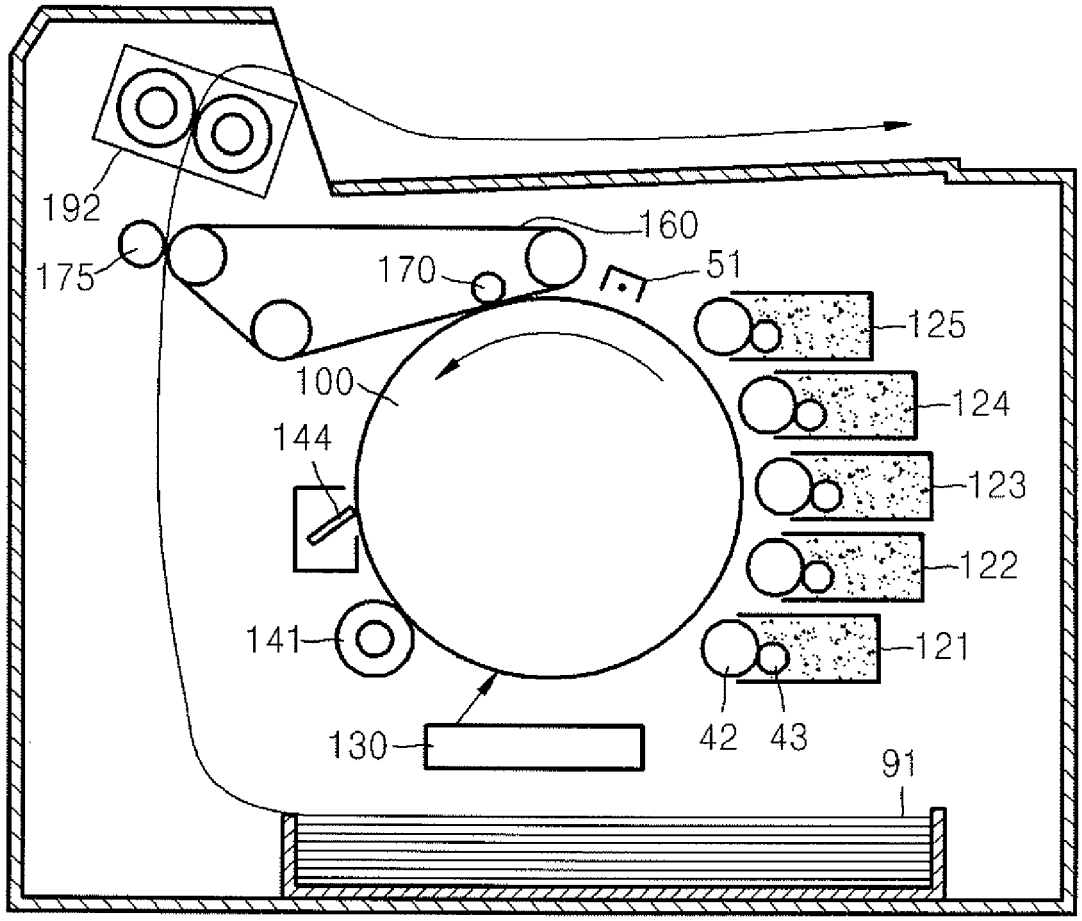
FIG. 7 illustrates the structure of a multiple pass color image forming apparatus which is a type of an electrophotographic image forming apparatus, according to another embodiment of the present general inventive concept.

The above-described printing method using the transparent toner and the color toners may also be applied to a multiple pass color image forming apparatus. FIG. 7 illustrates the structure of an electrophotographic image forming apparatus according to another embodiment of the present general inventive concept. The electrophotographic image forming apparatus according to the present embodiment is a multiple pass color image forming apparatus which includes a photosensitive drum 100, an exposing unit 130, and four developing units 121, 122, 123, and 124. Referring to FIG. 7, the four developing units 121, 122, 123, and 124 are disposed around the photosensitive drum 100. Color toner images such as black (B), magenta (M), cyan (C), and yellow (Y) are accommodated in the first developing units 121, 122, 123, and 124, respectively. The image forming apparatus according to the present embodiment further includes a second developing unit 125 in which a transparent toner and a white toner are accommodated. The transparent toner and the white toner are charged to different polarities. The image forming apparatus according to the present embodiment employs a non-contact developing technique in which the developing roller 42 is positioned to be separated from the photosensitive drum 100 by a developing gap. A contact developing technique in which the developing roller 42 contacts the photosensitive drum 100 may be employed. In this case, each of the first and second developing units 121, 122, 123, 124, and 125 may be sequentially in contact with or separated from the photosensitive drum 100. Even when the non-contact developing technique is employed, each of the first and second developing units 121, 122, 123, 124, and 125 may sequentially face the photosensitive drum 100. As an example, each of the first and second developing units 121, 122, 123, 124, and 125 may be installed at a rotating turret (not illustrated) and as the turret is rotated, each of the first and second developing units 121, 122, 123, 124, and 125 may sequentially face the photosensitive drum 100. In addition, the first and second developing units 121, 122, 123, 124, and 125 may be moved by using an actuator (not illustrated) and may sequentially face the photosensitive drum 100. The present general inventive concept is characterized in that the transparent toner image and the white toner image are developed using one developing unit and thus, the scope of the present general inventive concept is not limited by a developing technique.

The exposing unit 130 scans light onto the photosensitive drum 100 charged by a charging roller 141 to a uniform electric potential according to transparent (T) image information and white (W) image information and thereby forms an electrostatic latent image on the surface of the photosensitive drum 100. By using the second developing unit 125, the transparent toner image is attached to an image portion of the electrostatic latent image and the white toner image is attached to a non-image portion of the electrostatic latent image. A pre-transfer charging unit 51 changes the charging polarity of the white toner image into the same polarity as the charging polarity of the transparent toner image. The transparent toner image and the white toner image are transferred onto the intermediate transfer belt 160 by a first transfer bias voltage to be applied to a first transfer roller 170.

Next, the exposing unit 130 scans light onto the photosensitive drum 100 charged by a charging roller 141 to a uniform electric potential firstly according to black (B) image information, for example, and thereby forms an electrostatic latent image corresponding to black (B) on the surface of the photosensitive drum 100. When the black (B) toner is supplied to the electrostatic latent image by the developing unit 121, the black (B) toner image is formed on the surface of the photosensitive drum 100. The black toner image is transferred onto the intermediate transfer belt 160 by a first transfer bias voltage to be applied to the first transfer roller 170. A cleaning blade 144 eliminates the black toner image that remains on the photosensitive drum 100. When the block toner image which corresponds to a sheet of paper is entirely transferred onto the intermediate transfer belt 100, toner images of magenta (M), cyan (C), and yellow (Y) colors are sequentially transferred onto the intermediate transfer belt 160 through the same operation.

As such, color toner images of black (B), magenta (M), cyan (C), yellow (Y), and transparent (T) toner image, and a white (W) toner image are formed on the intermediate transfer belt 160. The toner images are transferred to the printing medium using a second transfer roller 175 and are fused on a fusing unit 192 so that color images whose gloss is improved can be printed.

According to the color images printed through the above-described operations, the image portion to which black (B), magenta (M), cyan (C), and yellow (Y) toner images are attached is covered with the transparent toner image, and a background portion in which the color toner images and the transparent toner image are not attached is covered with the white toner image. Thus, the gloss in the regions in which black (B), magenta (M), and cyan (C) toner images are attached is improved by the transparent toner image and simultaneously, the gloss in the regions are uniform and the background portion is covered with the white toner image and contamination of the background portion is prevented. As such, the transparent toner image and the white toner image are developed by using one developing unit so that an economically efficient and miniaturized multiple pass color image forming apparatus to improve the gloss of the printed image and to prevent contamination of the background portion.

In this case, in order to cover the color toner images with the transparent toner image and to cover the fog of the color toner images with the white toner image, the second developing unit 125 may firstly perform a developing operation and the transparent toner image and the white toner image may be first transferred onto the intermediate transfer belt 160.

The scope of the present general inventive concept is not limited by the above-described developing sequence of black (B), magenta (M), cyan (C), and yellow (Y) toner images. In addition, only a color image forming apparatus has been described in the above-described embodiments. However, the scope of the present general inventive concept is also not limited to use with color image forming apparatuses, but may also be applied to a single color image forming apparatus having a first developing unit in which a color toner is accommodated and a second developing unit in which a transparent toner and a white toner are together accommodated.

As described above, in the electrophotographic image forming apparatus according to the present general inventive concept, the transparent toner image is developed in the portion in which the color toner images are developed and the white toner image is developed in the background portion such that the gloss of the printed image is improved and is uniform and contamination of the background portion thereby degrading printing quality is prevented. In addition, the transparent toner image and the white toner image are developed by using one developing unit such that a miniaturized and economically efficient image forming apparatus is implemented.

Although a few embodiments of the present general inventive concept have been illustrated and described, it will be appreciated by those skilled in the art that changes may be made in these embodiments without departing from the principles and spirit of the general inventive concept, the scope of which is defined in the appended claims and their equivalents.

What is claimed is:

1. An electrophotographic image forming apparatus, the apparatus comprising:

first and second photosensitive bodies;

first and second exposing units to form an electrostatic latent image on the first and second photosensitive bodies respectively charged to a uniform electric potential;

a first developing unit to develop the electrostatic latent image of the first photosensitive body; and a single second developing unit in which a transparent toner and a white toner charged to different polarities are accommodated, the second developing unit developing the electrostatic latent image of the second photosensitive body by supplying the transparent toner to an image portion of the electrostatic latent image of the second photosensitive body and the white toner to a non-image portion of the electrostatic latent image of the second photosensitive body.

2. The apparatus of claim 1, further comprising:

a pre-transfer charging unit to charge a transparent toner image and a white toner image respectively developed on the second photosensitive body to the same polarity.

3. The apparatus of claim 2, further comprising:

a plurality of the first photosensitive bodies, a plurality of the first exposing units, and plurality of the first developing units, wherein the apparatus single-pass prints a plurality of color toner images with the plurality of the first photosensitive bodies, where the plurality of first exposing units form electrostatic latent image on the plurality of the first photosensitive bodies, and the plurality of the first developing units develop the electrostatic latent images of the plurality of the first photosensitive bodies by supplying different color toners thereto to print the plurality of color images.

4. The apparatus of claim 3, further comprising:

a carrying belt, wherein the plurality of color toner images and the transparent toner image and the white toner image are directly transferred to a printing medium carried by the carrying belt, and the second photosensitive body is spaced in a carrying direction of the printing medium from the plurality of the first photosensitive bodies.

5. The apparatus of claim 3, further comprising:

an intermediate transfer medium on which the plurality of color toner images formed on the plurality of first photosensitive bodies are transferred, and the transparent toner image and the white toner image formed on the second photosensitive body are transferred, wherein the second photosensitive body is positioned on an uppermost stream side in a progressive direction of the intermediate transfer medium before the plurality of the first photosensitive bodies that are positioned on a lowermost stream side.

* * * * *